United States Patent [19]

Hewitt

[11] 4,164,313

[45] Aug. 14, 1979

[54] CONTAINER

[75] Inventor: Edward G. Hewitt, Auburn, Mass.

[73] Assignee: New England Envelope Manufacturing Co., Worcester, Mass.

[21] Appl. No.: 882,146

[22] Filed: Feb. 28, 1978

[51] Int. Cl.[2] ..... B65D 5/24

[52] U.S. Cl. ..... 229/31 R; 292/150

[58] Field of Search ..... 229/31 R, DIG. 8, DIG. 4, 229/52 AW, 52 AM; 292/150; 206/424

[56] References Cited

U.S. PATENT DOCUMENTS

| | | | |
|---|---|---|---|
| D. 241,124 | 8/1976 | Poggiali | D9/245 |
| 265,985 | 10/1882 | Seabury | 229/31 R |
| 305,294 | 9/1884 | Corn | 292/150 X |
| 320,598 | 9/1887 | Best | 292/150 |
| 1,061,531 | 5/1913 | Emmons | 229/31 R X |
| 1,653,465 | 12/1927 | Montan et al. | 229/31 R |
| 2,022,566 | 11/1935 | Joslin | 229/34 |
| 3,001,688 | 9/1961 | Hokenson | 229/52 AW |
| 3,276,663 | 10/1966 | Falcomer | 229/52 AM X |
| 3,722,668 | 3/1973 | Carpenter | 206/424 |

*Primary Examiner*—Davis T. Moorhead

*Attorney, Agent, or Firm*—Norman S. Blodgett; Gerry A. Blodgett

[57] ABSTRACT

Corrugated board container with side wall which hinges outwardly for introduction and access to contents.

6 Claims, 6 Drawing Figures

CONTAINER

BACKGROUND OF THE INVENTION

There are many instances in business and industry where it is desirable to ship in a container a resilient or "fluffy" product under a slight compression to reduce its volume. It is also desirable to be able to relieve the compression at a later time to facilitate removal of the contents. A situation of this type is encountered in the envelope-making machine where the envelopes, when they leave the envelope-making machine are full of air and form a very bulky stack. It would be desirable to insert the envelopes in the shipping container under a slight lateral compression to force the air out of the stack of envelopes and to permit a much larger number of envelopes to be inserted in a given container. When the envelopes arrive at their destination and it is desirable to remove them from the envlope for use, it is helpful to remove the compression, so that one can easily insert his hand to remove a bundle of envelopes. In the past, envelopes have been shipped in an ordinary open-topped container and it is not only difficult to insert the envelopes tightly in such a container, but removing them is difficult also because of the necessity of inserting one's fingers into a tightly-compressed stack of envelopes in order to remove the supply that is needed. Attempts to overcome this problem in the past have resulted in containers that are both complicated and expensive and not entirely satisfactory for this particular purpose. These and other difficulties experienced with the prior art devices have been obviated in a novel manner by the present invention.

It is, therefore, an outstanding object of the invention to provide a container into which a resilient product can be easily introduced and easily removed.

Another object of this invention is the provision of a container for holding fluffy products, which container is not damaged by introduction and removal of the products, or the opening of the container, so that the container may be used over again repeatedly.

A further object of the present invention is the provision of a corrugated board container having a hinged panel for introduction and removal of products without spilling.

It is another object of the instant invention to provide an envelope shipping container which is simple in construction, which is inexpensive to manufacture, and which is capable of a long life of useful service with a minimum of maintenance.

A still further object of the invention is the provision of a container which has a hinged side panel and which can be formed from a single piece of corrugated board without waste.

It is a further object of the invention to provide a container for shipping resilient products including means integral with the container for producting a compressive force on the contents.

With these and other objects in view, as will be apparent to those skilled in the art, the invention resides in the combination of parts set forth in the specification and covered by the claims appended hereto.

SUMMARY OF THE INVENTION

In general, the present invention consists of a container formed substantially of a single piece of corrugated board and having a rectangular bottom wall, two opposed end walls each hingedly connected to the bottom wall at the end edges thereof, and two opposed side walls each hingedly connected to the bottom wall at end edges thereof. A gusset is provided at each corner joining an end edge of one of the side walls to the adjacent end edge of one of the end walls. Each gusset consists of a first triangular portion hingedly connected to the said end edge of the end wall and a second triangular portion hingedly connected to the said end edge of the side wall. The first and second triangular portions of each gusset wall. The first and second triangular portions of each gusset are hinged together. A removable clip normally maintains each gusset tightly pressed against the outer surface of its side wall.

More specifically, the triangular portion of each gusset that lies against the side wall has an upper edge which lies level with the upper edge of the side wall, while both edges have exposed vertical corrugation passages. The clip is U-shaped and has one leg residing in one corrugation passage of the side wall and the other leg residing in a corrugated passage of the triangular portion.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
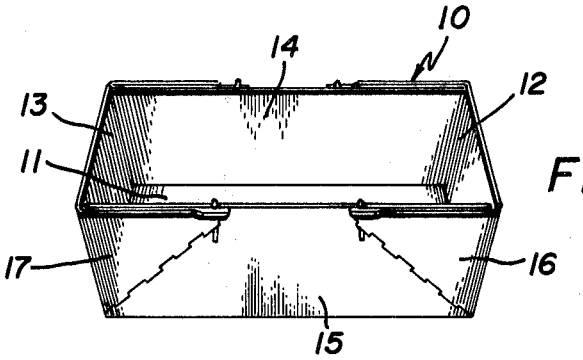
FIG. 1 is a perspective view of the container embodying the principles of the present invention.

Referring first to FIG. 1, it can be seen that the container, indicated generally by the reference numeral 10, is of an open-topped elongated rectangular form. For the purpose of the present application, the word "rectangular" shall be taken to mean also a square form. The container is generally formed of a single piece of corrugated board and has an elongated rectangular bottom wall 11, which has two elongated side edges and two short end edges. Two opposed end walls 12 and 13 are provided, each end wall being hingedly connected by a score line to the bottom wall 11 along the end edges therof. Two opposed side walls 14 and 15 are provided hingedly connected by means of score lines to the side edges of the bottom wall 11. Each side of the container is provided with two gussets 16 and 17, each joining an end edge of the side wall 15 to the adjacent end edge of the end walls 12 and 13, respectively. The gusset 17 consists of a first triangular portion 18 hingedly connected to the said end edge of the end wall 13 and a second triangular portion 19 hingedly connected to the said end edge of the side wall 15. The first and second triangular portions 18 and 19 of the gusset 17 are hinged together. A resilient clip 21 joins the gusset 17 to the side wall 15 at a position substantially spaced from the hinged connection thereto.

Figure 3:
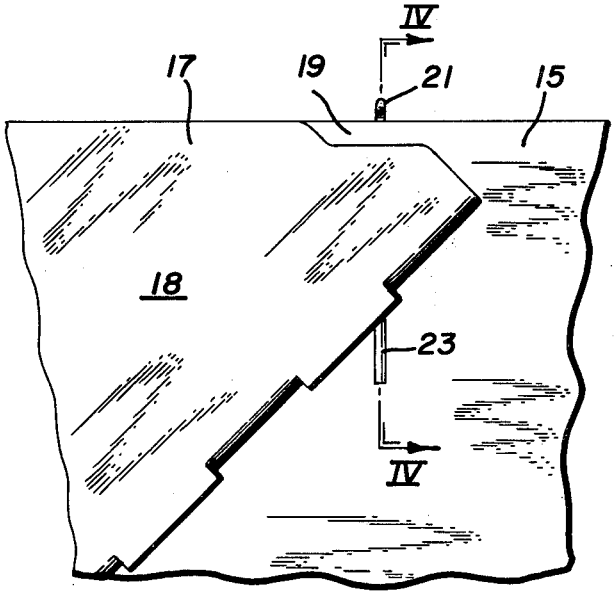
FIG. 3 is a front elevational view, somewhat enlarged, of a portion of the container.
Figure 4:
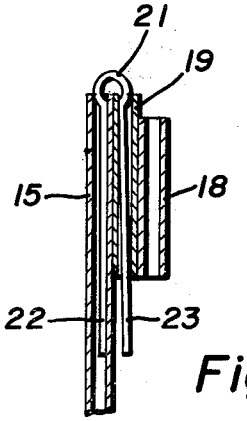
FIG. 4 is a vertical sectional view of the container taken on the line IV, IV of FIG. 3.

The bottom wall 11, the end walls 12 and 13, the side walls 14 and 15, as well as the gussets 16 and 17 on one side (and similar gussets on the other side) are all formed integrally from corrugated paper board. As is evident in FIGS. 1, 3, and 4, the first triangular portion 19 lies against the outside vertical surface of the side wall 15 and the first triangular portion 18 and the side wall 15 have upper edges that lie together with exposed vertical corrugation passages opening on the said upper edges. The clip 21 is U-shaped with one leg 22 lying in a corrugation passage in the side wall 15 and the other leg 23 lying in a corrugation passage in the second triangular portion 19. As is evident in FIG. 3, the clip 21 is located adjacent an acute angle of the triangular gusset and extends beyond the lower edge thereof, so that it is readily available for upward movement and for removal.

Figure 6:
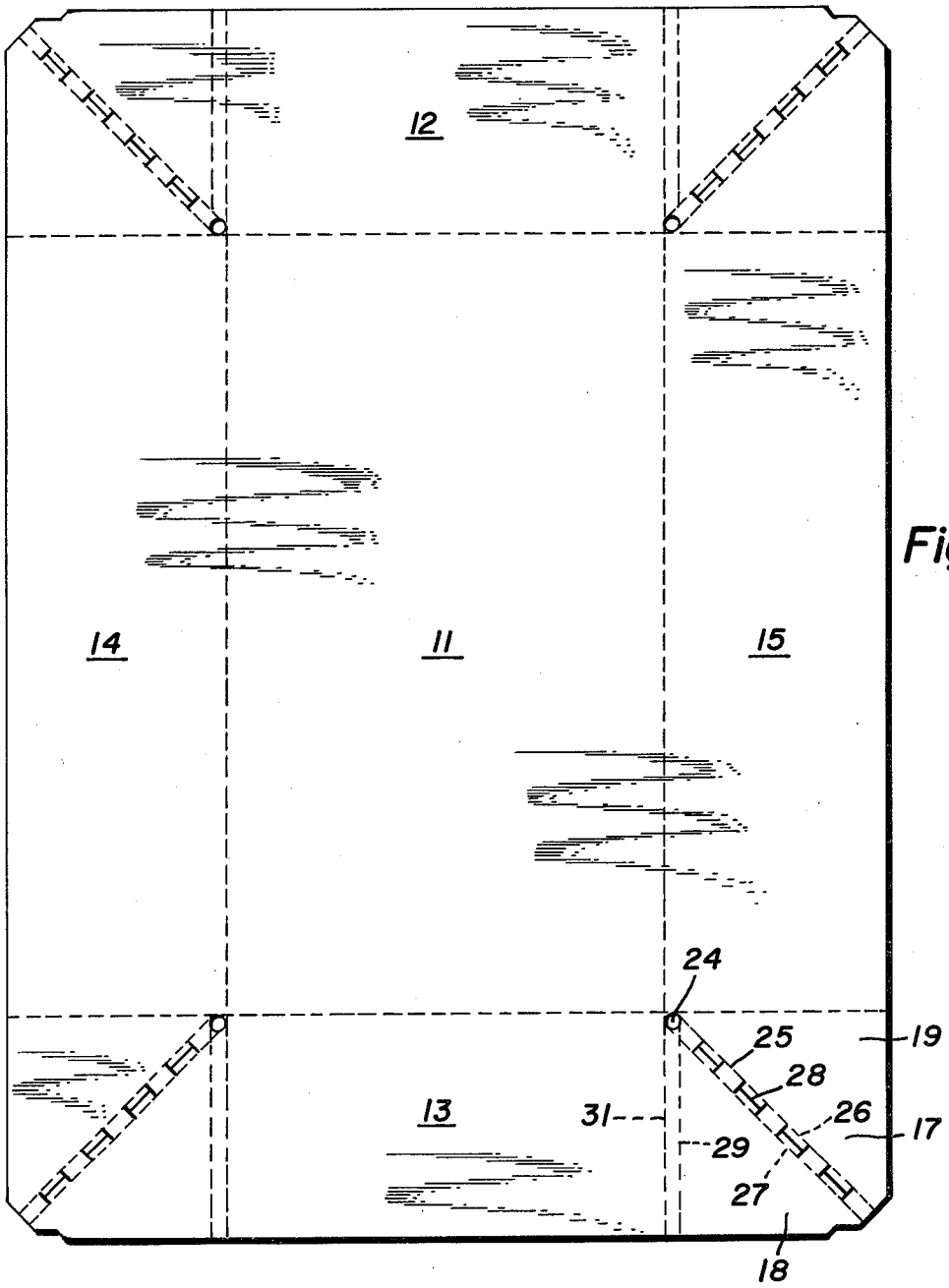
FIG. 6 is a plan view of a blank from which the container is formed.

As is best evident in FIG. 6, an aperture 24 extends through the paper board at the common intersection between the bottom wall 11, the side wall 15, the end wall 13, and the first and second triangular portions 18 and 19 of the gusset 17 to assist in forming the said gusset. The hinged connection between the first triangular portion 18 and the second triangular portion 19 consists of two parallel scores 26 and 27 and a plurality of H-shaped cuts 28. Each cut consists of two parallel cuts extending transversely between the scores 26 and 27 joined by a cut which extends midway between the scores. The hinge connection between the first triangular portion 18 and the end wall 13 consits of two-spaced parallel scores 29 and 31.

Figure 2:
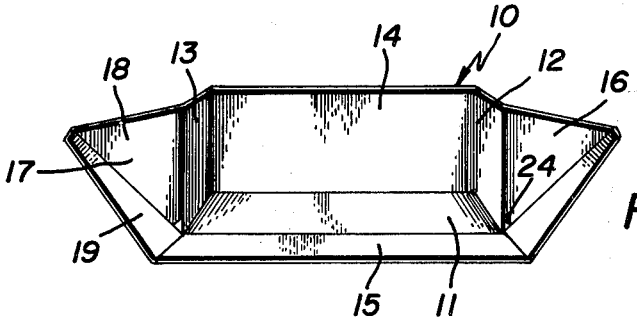
FIG. 2 is a perspective view of the container in open condition.
Figure 5:
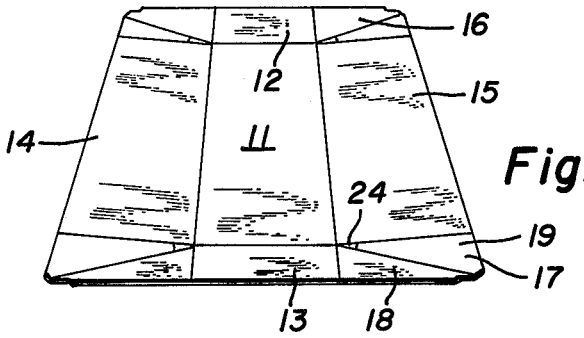
FIG. 5 is a perspective view of the container in completely dis-assembled or collapsed form.

The operation and the advantages of the present invention will now be readily understood in view of the above description. FIG. 1 shows the completely assembled container 10 which is intended to be used with envelopes extending parallel to the side walls 14 and 15. On those occasions where the envelopes are shorter than the container, there may be cross-walls inserted to separate groups of envelopes from one another, but these cross-walls are not shown in the drawings. FIG. 2 shows the container with the side 15 in lowered position ready to receive the envelopes. The half-open container would be generally positioned at a 45° angle for loading with the closed side toward loader. The envelopes are inserted and pressed back against the side wall 14. The wall 15 is raised and the gussets 16 and 17 are moved around. When the gussets are grasped (one in each hand) and moved toward their final positions against the side wall 15, they act as levers to force the wall 15 against the bundle of envelopes and to squeeze the envelopes together. Immediately after manufacture the envelopes are full of air and occupy greater volume when stacked than they will later contain. This also applies to situations where the paper product is made of thick, stiff paper. By inserting the envelopes in the box with one side open, it is possible to produce a lateral compressive force to compact the stack. Once the gussets have been pressed against the side wall 15, they are locked in place by use of the clip 21 in the manner shown in FIGS. 3 and 4. Later, the envelopes can be removed by removing the clips 23 and allowing the side wall 15 to fold downwardly. At that time the container has the appearance shown in FIG. 2 and is useful as a storage holder for the envelopes until they are completely used. FIG. 5 shows the appearance of the container after all of the clips have been removed and the complete container laid out flat. It is then possible, since it occupies so little space, to dispose of it in this condition or to return it for re-use. In any case, it is easily stored and transported in the flat condition. FIG. 6 shows the blank from which the container is made with all of the score lines, as well as the apertures similar to the aperture 24. The gusset 17 has been completely described in detail, but it will be understood that the gusset 16 and all of the other gussets are similarly constructed. The fact that the leg 23 extends downwardly below the lower edge of the first triangular portion 18 of the gusset 17 means that a simple blunt tool can be used to push the clip to an upwardly-extending position where it may be pinched between the thumb and forefinger and lifted away from the gusset; the container is then free to open. Therefore, it can be seen that the container of this type allows easy removal of the contents by opening one side and that it is easy to load by reversing the procedure. Furthermore, by opening both sides, the container becomes simple and compact for disposal or re-use. Normally, an open-topped container of this type in the envelope industry is used without a cover; the full containers are simply stacked on the pallet and between each layer is a common cover for a multiple number of containers or the containers can have individual covers that are either separate or attached.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Container, comprising:

(a) a rectangular bottom wall, (b) two opposed end walls, each hingedly connected to the bottom wall at an end edge thereof, (c) two opposed side walls, each hingedly connected to the bottom wall at a side edge thereof, (d) two gussets integrally formed with the bottom, side, and end walls from corrugated paper board, each gusset joining an end edge of one of the side walls to the adjacent end edge of one of the end walls, each gusset consisting of a first triangular portion hingedly connected to the said end edge of the end wall and lying against the outside vertical surface of the side wall and a second triangular portion hingedly connected to the said end edge of the side wall, the first and second triangular portions and side wall having upper edges that lie together with exposed vertical corrugation passages opening on the said upper edges, and (e) a resilient U-shaped clip joining each gusset to the side wall at a position substantially spaced from the hinged connection thereto.

2. Container as recited in claim 1, wherein one leg of the clip lies in a corrugated passage in the side wall and the other leg lies in a corrugated passage in the second triangular portion.

3. Container as recited in claim 1, wherein the clip is located adjacent an acute angle of the triangle and extends beyond the lower edge thereof, so that it is readily available for upward movement and removal.

4. Container as recited in claim 1, wherein a large aperture extends through each common intersection between the bottom, side, and end walls and the first and second triangular portions to assist in forming the gusset.

5. Container as recited in claim 1, wherein the hinged connection between the first and second triangular portions consists of two parallel scores and a plurality of H-shaped cuts, each cut consisting of two parallel cuts extending transversely between the scores joined by a cut extending midway between the scores.

6. Container as recited in claim 1, wherein the hinged connection between the first triangular portion and the adjacent end wall consists of two spaced parallel scores.

* * * * *